US005767057A

United States Patent [19]

Merz et al.

[11] Patent Number: 5,767,057

[45] Date of Patent: Jun. 16, 1998

[54] SPRAY-DRIED GRANULES OF HIGH APPARENT DENSITY

[75] Inventors: Thomas Merz, Hilden; Elmar Wilms, Dormagen, both of Germany; Chris De Jong, Nieuwegein, Netherlands

[73] Assignee: Henkel-Ecolab GmbH & Co. OHG, Duesseldorf, Germany

[21] Appl. No.: 596,358

[22] PCT Filed: Aug. 25, 1994

[86] PCT No.: PCT/EP94/02815

§ 371 Date: Mar. 4, 1996

§ 102(e) Date: Mar. 4, 1996

[87] PCT Pub. No.: WO95/07339

PCT Pub. Date: Mar. 16, 1995

[30] Foreign Application Priority Data

Sep. 4, 1993 [DE] Germany ..... 43 29 988.1

[51] Int. Cl.[6] ..... C11D 11/02

[52] U.S. Cl. ..... 510/452; 510/454; 510/488

[58] Field of Search ..... 510/452, 454

[56] References Cited

U.S. PATENT DOCUMENTS

| | | | |
|---|---|---|---|
| 3,743,610 | 7/1973 | Weldes | 510/452 |
| 3,920,586 | 11/1975 | Bonaparte et al. | 510/349 |
| 4,536,319 | 8/1985 | Payne | 510/454 |
| 4,552,681 | 11/1985 | Koch et al. | 252/140 |
| 4,652,391 | 3/1987 | Balk | 252/99 |
| 4,737,306 | 4/1988 | Wichelhaus et al. | 252/99 |
| 4,755,318 | 7/1988 | Davies et al. | 510/454 |
| 4,816,553 | 3/1989 | Baur et al. | 528/245 |
| 5,082,504 | 1/1992 | Leupold et al. | 510/454 |
| 5,242,615 | 9/1993 | Urfer et al. | 510/452 |
| 5,565,137 | 10/1996 | Capeci | 510/216 |
| 5,569,645 | 10/1996 | Dinniwell et al. | 510/276 |

FOREIGN PATENT DOCUMENTS

| | | |
|---|---|---|
| 981141 | 7/1973 | European Pat. Off. . |
| 026529 | 9/1980 | European Pat. Off. . |
| 0120492 | 10/1984 | European Pat. Off. . |
| 0179264 | 4/1986 | European Pat. Off. . |
| 3526405 | 2/1987 | European Pat. Off. . |
| 0280223 | 8/1988 | European Pat. Off. . |
| 2334899 | 12/1983 | Germany . |
| 4238032 | 5/1994 | Germany . |
| 4319578 | 12/1994 | Germany . |
| 58-217598 | 12/1983 | Japan . |
| 1400898 | 7/1972 | United Kingdom . |
| WO9013533 | 11/1990 | WIPO . |
| WO9211346 | 7/1992 | WIPO . |

*Primary Examiner*—Ellen M. McAvoy

*Attorney, Agent, or Firm*—Ernest G. Szoke; Wayne C. Jaeschke; Real J. Grandmaison

[57] ABSTRACT

The process of producing spray-dried granules useful as detergents, cleaning compositions, or as a component therefor, by preparing a slurry containing 0.2% to 20% by weight of sugar acids or salts thereof and the balance being detergent components, wherein the slurry contains less than 35% by weight of water and has a viscosity of less than 15,000 mPas under spray-drying conditions, and spray-drying the slurry.

20 Claims, No Drawings

SPRAY-DRIED GRANULES OF HIGH APPARENT DENSITY

BACKGROUND OF THE INVENTION

1. Field of the Invention

This invention relates to spray-dried granules which are particularly suitable for use as detergents or cleaning compositions or for use in detergents or cleaning compositions and which have an apparent density of at least 700 g/l and to a spray-drying process for the production of these heavy granules.

It is generally known that, depending on the formulation, apparent densities of around 600 to 650 g/l can be obtained by conventional spray drying in which inflated, i.e. porous, granules are generally formed. A further increase in apparent density can be obtained either by spraying these porous granules with nonionic surfactants, in which case the pores of the granules are filled, or by powdering them with fine-particle powders, for example zeolite powders.

2. Discussion of Related Art

European patent application EP-A-0 120 492 describes special spray-dried granules which even reach an apparent density of at least 550 g/l to 800 g/l without the above-described aftertreatment. These granules contain ethoxylated alcohols containing 12 to 24 carbon atoms and an average of 3 to 20 ethylene oxide groups. To achieve an apparent density as high as this, it is essential that the content of anionic surfactants in these granules should be less than 1% by weight and the soap content less than 0.2% by weight because small quantities of such additives lead during spray drying to inflation of the granules and hence to a reduction in the desired high apparent density and to a deterioration in the flow properties of the granules. The granules are produced by a process in which a slurry containing 55 to 35% by weight of water (including the water bound by adsorption or as hydrate) is sprayed. However, the water content is preferably no lower than 42% by weight because lower contents lead to a significant increase in the viscosity of the slurry and necessitate the addition of viscosity-reducing agents, such as toluene, xylene or cumene sulfonate. Slurry viscosities of up to at most 15,000 mPas under operating conditions are regarded as acceptable.

The problem addressed by the present invention was to make the spray drying process more favorable from the energy point of view and to obtain an increase in the performance of the spray drying towers and hence an increase in the capacity of existing installations for the same energy consumption. To this end, it should be possible to spray slurries of higher concentration. However, these slurries should not have such high viscosities that they can no longer be sprayed. In addition, there would be no need for additives, such as toluene, xylene or cumene sulfonate, as typical viscosity-reducing agents.

DESCRIPTION OF THE INVENTION

It has now been found that slurries of relatively high concentration can be sprayed in conventional spray drying towers if they contain certain additional substances which are already known ingredients of detergents or cleaning compositions where they are used in particular as co-builders.

In a first embodiment, therefore, the present invention relates to spray-dried granules which may be used in particular as detergents or cleaning compositions or as a component therefor, contain nonionic surfactants in the quantities mentioned below, but anionic surfactants in quantities of less than 1% by weight and soap in quantities of less than 0.2% by weight and have an apparent density of at least 550 g/l, the granules containing 1 to 30% by weight of nonionic surfactants and, in addition, sugar acids or salts of sugar acids.

Preferred granules have an apparent density of at least 600 g/l, preferably 700 to 1000 g/l and, more preferably, around 750 to 800 g/l. In the context of the present invention, spray-dried granules of high apparent density, more particularly with apparent densities of at least 700 g/l, are produced exclusively by a spray drying process. Aftertreatments, such as impregnation with liquid to wax-like components, for example nonionic surfactants, powdering with fine-particle powders or the use of the granules in mixing and/or granulation or extrusion processes optionally having an even greater compacting effect, are by no means ruled out, but are not essential to the invention. Accordingly, the apparent density data always relate to the basic granules obtained by spray drying.

Granules according to the present invention are substantially free from typical anionic surfactants and soaps. Their anionic surfactant content is less than 1% by weight while their soap content is less than 0.2% by weight. Preferred spray-dried granules are even completely free from anionic surfactants and/or soaps.

By contrast, the nonionic surfactant content of the granules is preferably from 2 to 25% by weight and, more preferably, from 5 to 20% by weight. Preferred nonionic surfactants are alkoxylated, advantageously liquid ethoxylated, more especially primary alcohols preferably containing 8 to 24 carbon atoms and, more particularly, 8 to 18 carbon atoms and an average of 1 to 80 moles of ethylene oxide (EO) per mole of alcohol, in which the alcohol radical may be linear or, preferably, 2-methyl-branched or may contain the mixtures of linear and methyl-branched radicals typically present in oxoalcohol radicals. However, alcohol ethoxylates containing linear radicals of alcohols of native origin with 12 to 18 carbon atoms, for example coconut oil, palm kernel oil, tallow fatty or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a particular product, may be a whole number or a broken number. Other preferred nonionic surfactants are, in particular, tallow fatty alcohols containing 11 EO, 14 EO, 25 EO, 30 EO or 40 EO. On account of the well-known pluming problem attending the spray drying of ethoxylated alcohols, which is produced by the steam volatility of unreacted alcohol and alcohols with low degrees of ethoxylation, the ethoxylated fatty alcohols preferably used contain an average of at least 5 EO groups in the molecule. For the same reason, preferred alcohol ethoxylates also have a narrow homolog distribution (narrow range ethoxylates, NRE). Tallow fatty alcohols or $C_{12-18}$ fatty alcohols containing 5 to 25 EO, preferably mixtures of fatty alcohols containing 5 EO and/or 7 EO and 25 EO or mixtures of fatty alcohols containing 5 EO and 14 EO, are particularly preferred.

Suitable alkoxylated alcohols may also be propoxylated or both ethoxylated and propoxylated. According to the invention, however, it is preferred to use only ethoxylated alcohols by virtue of the better resulting product properties. The content of ethoxylated fatty alcohols, particularly tallow fatty alcohols containing 5 to 25 EO, in the granules is in particular from 10 to 15% by weight.

In addition, alkyl glycosides corresponding to the general formula $RO(G)_x$, in which R is a primary linear or methyl-branched, more especially 2-methyl-branched, aliphatic radical containing 8 to 22 carbon atoms and preferably 12 to 18 carbon atoms and G stands for a glycose unit containing 5 or 6 carbon atoms, preferably glucose, may also be used as additional nonionic surfactants. The degree of oligomerization x, which indicates the distribution of monoglycosides and oligoglycosides, is a number of 1 to 10 and preferably from 1.2 to 1.4.

Another class of preferred nonionic surfactants, which are used either as sole nonionic surfactant or in combination with other surfactants, more particularly with alkoxylated fatty alcohols, are alkoxylated and preferably ethoxylated or ethoxylated and propoxylated fatty acid alkyl esters, preferably containing 1 to 4 carbon atoms in the alkyl chain, more particularly the fatty acid methyl esters described, for example, in Japanese patent application JP 58/217598 or those preferably produced by the process described in International patent application WO-A-90/13533.

Nonionic surfactants of the amine oxide type, for example N-cocoalkyl-N,N-dimethylamine oxide and N-tallowalkyl-N,N-dihydroxyethylamine oxide, and the fatty acid alkanolamides are also suitable nonionic surfactants. The quantity in which these nonionic surfactants are used is preferably no more than that and, more preferably, no more than half that in which the ethoxylated fatty alcohols are used.

Other suitable surfactants are polyhydroxy fatty acid amides corresponding to formula (I):

$$R^2-CO-\overset{\overset{\displaystyle R^3}{|}}{N}-[Z] \qquad (I)$$

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxy fatty acid amides are known substances which may typically be obtained by reductive amination of a reducing sugar with ammonia, an alkylamine or an alkanolamine and subsequent acylation with a fatty acid, a fatty acid alkyl ester or a fatty acid chloride.

The granules preferably contain as sugar acids or salts of sugar acids polyhydroxymonocarboxylic acids or polyhydroxymonocarboxylic acid salts containing 4 to 6 carbon atoms, each carbon atom that does not bear a carboxyl group or keto group carrying a hydroxy group, and/or polyhydroxydicarboxylic acids or polyhydroxydicarboxylic acid salts containing 4 to 6 carbon atoms and at least two hydroxy groups per molecule or mixtures of these acids and salts. Polyhydroxymonocarboxylic acids or polyhydroxymonocarboxylic acid salts containing one keto group per molecule, preferably lactones, are formed. Preferred polyhydroxymonocarboxylic acids or polyhydroxymonocarboxylic acid salts are those which contain 4 to 6 carbon atoms and which carry a hydroxy group at each carbon atom that does not bear a carboxyl group or keto group. Polyhydroxymonocarboxylic acids and polyhydroxymonocarboxylic acid salts containing 4 carbon atoms and 3 hydroxy groups, 5 carbon atoms and 4 hydroxy groups and 6 carbon atoms and 4 or 5 hydroxy groups are particularly preferred. Particularly advantageous properties are exhibited by polyhydroxymonocarboxylic acids or polyhydroxymonocarboxylic acid salts containing 6 carbon atoms and 5 hydroxy groups, such as D-gluconic acid (also known as maltonic acid or dextronic acid) or salts thereof and polyhydroxymonocarboxylic acids or polyhydroxymonocarboxylic salts containing 6 carbon atoms, 1 keto group and 4 hydroxy groups, such as L-ascorbic acid, which is also present as lactone, and L-ascorbic acid salts. Mixtures of the acids and/or salts may be used, the salts preferably being the sodium or potassium salts. However, polyhydroxydicarboxylic acids or polyhydroxydicarboxylic acid salts which contain 4 to 6 carbon atoms and which carry a hydroxy group at each carbon atom that does not bear a carboxyl group are also preferred. Accordingly, particular preference is attributed to polyhydroxydicarboxylic acids and polyhydroxydicarboxylic acid salts containing 4 carbon atoms and 2 hydroxy groups, such as tartaric acid and tartaric acid salts, and 6 carbon atoms and 4 hydroxy groups, such as galactaric acid (also known as mucic acid) and galactaric acid salts and also glucaric acid (also known as saccharic acid) and glucaric acid salts. Mixtures of the acids, the monosalts and/or the disalts may also be used. The salts are preferably used in the form of sodium or potassium salts. Accordingly, particularly advantageous polyhydroxydicarboxylic acid salts include the monosodium salts and disodium salts and the monopotassium and dipotassium salts of tartaric acid, galactaric acid and D-glucaric acid.

The content of sugar acids and, preferably, salts of sugar acids in the spray dried granules is preferably from 0.2 to 20% by weight and, more preferably, from 0.5 to 15% by weight. Spray-dried granules containing 1 to 10% by weight and advantageously 2 to 5% by weight of gluconic acid, gluconate or mixtures thereof are particularly preferred.

The granules according to the invention may contain other ingredients typically used in detergents or cleaning compositions. Preferred granules, which are used either as household detergents or as a component of household detergents or institutional detergents, preferably contain inorganic or inorganic and organic builders. Inorganic builders include above all phosphates, more particularly the known tripolyphosphates, and zeolite.

The finely crystalline, synthetic zeolite containing bound water used is preferably zeolite NaA in detergent quality. However, zeolite NaX, zeolite P and mixtures of NaA, NaX and optionally P are also suitable. The zeolite may be used in the form of a spray-dried powder although it may also be used with advantage in the form of an undried stabilized suspension still moist from its production. In cases where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 EO or ethoxylated isotridecanols. Suitable zeolites have an average particle size of less than 10 μm (volume distribution, as measured by the Coulter Counter method) and preferably contain 18 to 22% by weight and, more preferably, 20 to 22% by weight of bound water.

Suitable substitutes or partial substitutes for the zeolite are layer silicates of natural and synthetic origin. Corresponding layer silicates are known, for example, from patent applications DE-B-23 34 899, EP-A-0 026 529 and DE-A-35 26 405. However, their suitability is not confined to a particular composition or structural formula. However, smectites and especially bentonites are preferred.

The phosphate and/or zeolite content of the spray-dried granules is preferably from 20 to 60% by weight and, more preferably, from 20 to 50% by weight, based on water-free active substance. Small quantities of 20 to 25% by weight may be used with advantage in particular when phosphates and zeolites are used.

Useful organic builders which may be used in addition to the sugar acids or their salts are, for example, the polycarboxylic acids preferably used in the form of their sodium salts, such as citric acid, adipic acid, succinic acid, glutaric acid, aminocarboxylic acids, nitrilotriacetic acid (NTA), providing their use is not objectionable on ecological grounds, and mixtures thereof. Preferred salts are the salts of polycarboxylic acids, such as citric acid, adipic acid, succinic acid, glutaric acid and mixtures thereof.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and those of acrylic acid or methacrylic acid with maleic acid. Copolymers of acrylic acid with maleic acid containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000.

The (co)polymeric polycarboxylates may be used either in the form of a powder or in the form of an aqueous solution, 20 to 55% by weight aqueous solutions being preferred.

Other suitable builders are polyacetals which may be obtained by reaction of dialdehydes with polyol carboxylic acids containing 5 to 7 carbon atoms and at least 3 hydroxyl groups, for example as described in European patent application EP-A-0 280 223. Preferred polyacetals are obtained from dialdehydes, such as glyoxal, glutaraldehyde, terephthalaldehyde and mixtures thereof, and from polyol carboxylic acids, such as gluconic acid and/or glucoheptonic acid.

Other suitable ingredients of the granules are water-soluble inorganic salts, such as bicarbonates, carbonates, amorphous silicates or mixtures thereof. Alkali metal carbonate and amorphous alkali metal silicate, above all sodium silicate with a molar ratio of $Na_2O$ to $SiO_2$ of 1:1 to 1:4.5 and preferably 1:2 to 1:3.5, are particularly suitable. The sodium carbonate content of the granules is preferably up to 20% by weight and advantageously from 5 to 15% by weight where the granules are to be used in the home and may be increased to a content of preferably up to 50% by weight and, more preferably, up to 45% by weight for institutional applications. The sodium silicate content of the granules is generally up to 10% by weight and preferably from 2 to 8% by weight, quantities of silicate of at most 3% by weight being preferred for zeolite-containing granules.

According to the teaching of earlier German patent application P 43 19 578.4, alkali metal carbonates may even be replaced by sulfur-free amino acids containing 2 to 11 carbon atoms and, optionally, another carboxyl and/or amino group and/or salts thereof. According to the invention, the alkali metal carbonates are preferably partly or completely replaced by glycine or glycinate.

The other detergent ingredients which may be present in the granules include redeposition inhibitors, foam inhibitors, optical brighteners, enzymes, fabric softeners, dyes and fragrances and neutral salts, such as sulfates and chlorides in the form of their sodium or potassium salts.

Where the granules are used in machine washing processes, it can be of advantage to add conventional foam inhibitors to them. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamine. Mixtures of different foam inhibitors, for example those of silicones, paraffins or waxes, are also used with advantage.

The neutrally reacting sodium salts of, for example, 1-hydroxyethane-1,1-diphosphonate and diethylenetriamine pentamethylene phosphonate are preferably used in quantities of 0.1 to 1.5% by weight as the salts of polyphosphonic acids.

Suitable enzymes are enzymes from the class of proteases, lipases, amylases, cellulases and mixtures thereof. Enzymes obtained from bacterial strains or fungi, such as *Bacillus subtilis, Bacillus licheniformis* and *Streptomyces griseus*, are particularly suitable. Proteases of the subtilisin type and, in particular, proteases obtained from *Bacillus lentus* are preferably used. Enzyme mixtures, for example of protease and amylase or protease and lipase or protease and cellulase or of cellulase and lipase or of protease, amylase and lipase or protease, lipase and cellulase, but especially cellulase-containing mixtures, are of particular interest. Oxidases and peroxidases have also proved to be suitable in some cases. The percentage content of enzymes, enzyme mixtures or enzyme granules may be, for example, from about 0.1 to 5% by weight and is preferably from 0.1 to about 2% by weight.

The function of redeposition inhibitors is to keep the soil detached from the fibers suspended in the liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or of cellulose or salts of acidic sulfuric acid esters of cellulose or starch. Water-soluble polyamides containing acidic groups are also suitable for this purpose. Other suitable redeposition inhibitors are soluble starch preparations and other starch products than those mentioned above, for example degraded starch, aldehyde starches, etc. Polyvinyl pyrrolidone may also be used. However, cellulose ethers, such as carboxymethyl cellulose, methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are preferably used.

The granules may contain derivatives of diaminostilbene disulfonic acid or alkali metal salts thereof as optical brighteners. Suitable optical brighteners are, for example, salts of 4,4'-bis-(2-anilino-4-morphilino-1,3,5-triazinyl-6-amino)-stilbene-2,2'-disulfonic acid or compounds of similar structure which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned above may also be used.

In one preferred embodiment of the invention, however, the spray-dried granules are produced without bleaching agents, bleach activators and enzymes and optionally without foam inhibitors. These standard ingredients of household detergents may advantageously be subsequently mixed with the spray-dried granules either as a raw material or in the form of a compound prepared beforehand.

In another preferred embodiment of the invention, the spray-dried granules are used as basic granules for the production of institutional detergents. In this case, they may be mixed, for example, with alkaline substances, such as metasilicate.

The percentage content of spray-dried granules in domestic or institutional detergents is preferably from 40 to 90% by weight and more preferably from 50 to 85% by weight.

The present invention also relates to a process for the production of spray-dried granules and, more particularly, for the production of the above-mentioned granules according to the invention which may be used in particular as detergents or cleaning compositions or as a component therefor. Production is carried out via the spray drying of a slurry containing less than 35% by weight of water. The viscosity of the slurry under the operating conditions should be no more than 15,000 mPas in order to ensure safe processing of the slurry in the tower. According to the invention, it is possible and therefore preferred further to reduce the water content of the slurry. Thus, water contents of at most 30% by weight, preferably from 15 to 30% by weight and more preferably from 15 to 25% by weight are preferred. Another preferred embodiment of the invention is characterized by the use of slurries which have a viscosity under the operating conditions of less than 12,000 mPas and, more particularly, in the range from 5,000 to 10,000 mPas. Corresponding slurries are obtained when they contain polyhydroxymonocarboxylic acids according to the invention or salts thereof, polyhydroxydicarboxylic acids or salts thereof or mixtures of these mono- and/or di-compounds in the quantities indicated. However, polyhydroxymonocarboxylic acids or polyhydroxymonocarboxylic acid salts are preferably used, gluconic acid and advantageously gluconate being particularly preferred. The sugar acids and, in particular, the salts of the sugar acids may be incorporated in the slurry in solid form or in the form of an aqueous solution, for example in the form of a 60 to 80% by weight aqueous solution.

The apparent densities of the granules thus produced may vary within wide limits. The expert knows those parameter changes in the spray drying process which lead to lighter granules and those which lead to heavier granules. For example, it is possible to produce granules with an apparent density of 550 g/l and higher. However, apparent densities of 700 to 1000 g/l and, more particularly, of the order of 750 to 800 g/l are preferably established in this spray-drying process. These apparent densities can readily be established in conventional spray drying towers.

This process not only solves the problems of increasing the performance levels and capacities of the spray-drying towers for the same energy consumption (increases in performance of 20% and higher are possible) while at the same time ensuring the processability of highly concentrated slurries (concentration by 10% or more in relation to the prior art is possible), a higher degree of phosphate retention is also achieved in the spray drying of tripolyphosphate-containing granules. This can be explained, for example, by the fact that the reduction in the slurry viscosities also enables the tower entry temperatures to be reduced (lower energy consumption), thereby suppressing decomposition of the tripolyphosphate. This in turn means that smaller quantities of phosphates can be used through the increased degree of retention without any deterioration in the primary washing performance.

However, another significant advantage is the increase in the apparent density of the spray-dried granules so that further compacting measures (for example compacting granulation) are largely unnecessary. The advantage of this is that uniform free-flowing, heavy but low-dust granules are obtained. The possibility of reducing the tower entry temperatures enables the user to incorporate higher percentages of ethoxylated fatty alcohols in the spray-dried granules because the notorious problem of pluming (plume of smoke caused by escaping fatty alcohol ethoxylates) is also reduced by the lower temperatures.

EXAMPLES

Comparison Example C1

Granules C1 with the composition shown below were produced by spray drying:

| | |
|---|---|
| Tallow fatty alcohol · 5 EO | 7% by weight |
| Tallow fatty alcohol · 14 EO | 7% by weight |
| Sodium carbonate | 41% by weight |
| Sodium tripolyphosphate | 31.5% by weight |
| Sodium silicate ($Na_2O:SiO_2$ 1:3.0) | 4.5% by weight |
| Carboxymethyl cellulose (CMC) and methyl cellulose (MC) | 0.9% by weight |
| Optical brightener | 0.2% by weight |
| 1-Hydroxyethane-1,1-diphosphonate (HEDP) | 0.35% by weight |
| Water | balance to 100% by weight |

In Comparison Example C1, the slurry concentration was 69.3% by weight and the viscosity under operating conditions was 7500 mPas. The apparent density was 567 g/l.

Example M1/1

The Comparison Example was repeated; the operating conditions of the spray drying tower were established as in C1 with no changes and 2% by weight, based on the spray-dried granules, of sodium gluconate in solid form (100% by weight) were used instead of sodium carbonate. The slurry concentration was still 69.3% by weight and the viscosity under operating conditions was 5300 mPas. The apparent density of the spray-dried granules M1/1 was 631 g/l.

Example 2

Comparison granules C2 and granules M2/1 to M2/6 according the invention

Comparison granules C2 with the same composition as C1 above were prepared by spray drying of a 69.8% by weight slurry. The viscosity of the slurry under operating conditions was again 7500 mPas and the apparent density 570 g/l.

M2/1

Repetition of the Example with 0.7% by weight, based on the spray-dried granules, of sodium gluconate instead of sodium carbonate. The gluconate was incorporated in the slurry in the form of a 70% by weight aqueous solution. The viscosity of the slurry under operating conditions was 6300 mPas. The apparent density of the spray-dried granules was 590 g/l.

M2/2

Repetition of the Example with 1.4% by weight, based on the spray-dried granules, of sodium gluconate instead of sodium carbonate. The gluconate was incorporated in the slurry in the form of a 70% by weight aqueous solution. The viscosity of the slurry under operating conditions was 5300 mPas. The apparent density of the spray-dried granules was 617 g/l.

M2/3

Repetition of the Example with 2.8% by weight, based on the spray-dried granules, of sodium gluconate instead of sodium carbonate. The gluconate was incorporated in the slurry in the form of a 70% by weight aqueous solution. The viscosity of the slurry under operating conditions was 4200 mPas. The apparent density of the spray-dried granules was 639 g/l.

M2/4

Repetition of the Example with a 70.1% by weight slurry and 1% by weight, based on the spray-dried granules, of sodium gluconate instead of sodium carbonate. The gluconate was incorporated in the slurry in solid form (100% by weight). The viscosity of the slurry under operating conditions was 6500 mPas. The spray-dried granules had an apparent density of 643 g/l.

M2/5

Repetition of the Example with a 70.4% by weight slurry and 2% by weight, based on the spray-dried granules, of sodium gluconate instead of sodium carbonate. The gluconate was incorporated in the slurry in solid form (100% by weight). The viscosity of the slurry under operating conditions was 5300 mPas. The spray-dried granules had an apparent density of 657 g/l.

M2/6

Repetition of the Example with a 71.0% by weight slurry and 4% by weight, based on the spray-dried granules, of sodium gluconate instead of sodium carbonate. The gluconate was incorporated in the slurry in solid form (100% by weight). The viscosity of the slurry under operating conditions was 5000 mPas. The spray-dried granules had an apparent density of 682 g/l.

Example 3

Comparison granules C3 and granules M3/1 to M3/2 according to the invention

Comparison granules C3 with the same composition as C1 and C2 were produced by spray drying a 72.9% by weight slurry. However, the viscosity under operating conditions was well above 20,000 mPas.

M3/1

Repetition of the Example with a 73.4% by weight slurry and 2% by weight, based on the spray-dried granules, of sodium gluconate instead of sodium carbonate. The gluconate was incorporated in the slurry in solid form (100% by weight). The viscosity of the slurry under operating conditions was 8000 mPas. The spray-dried granules had an apparent density of 706 g/l.

M3/2

Repetition of the Example with a 74.0% by weight slurry and 4% by weight, based on the spray-dried granules, of sodium gluconate instead of sodium carbonate. The gluconate was incorporated in the slurry in solid form (100% by weight). The viscosity of the slurry under operating conditions was 7000 mPas. The spray-dried granules had an apparent density of 742 g/l.

Example 4

Comparison granules C4 and granules M4/1 to M4/4 according to the invention

Comparison granules C4 with the same composition as C1 to C3 were to be produced by spray drying of a 74.6% by weight slurry. The viscosity under operating conditions was not measurable and the slurry could not be stirred.

M4/1

Repetition of the Example with a 75.1% by weight slurry and 2% by weight, based on the spray-dried granules, of sodium gluconate instead of sodium carbonate. The gluconate was incorporated in the slurry in solid form (100% by weight). The viscosity of the slurry under operating conditions was 11,500 mPas. The spray-dried granules had an apparent density of 758 g/l.

M4/2

Repetition of the Example with a 75.6% by weight slurry and 4% by weight, based on the spray-dried granules, of sodium gluconate instead of sodium carbonate. The gluconate was incorporated in the slurry in solid form (100% by weight). The viscosity of the slurry under operating conditions was 9700 mPas. The spray-dried granules had an apparent density of 769 g/l.

M4/3

2% by weight, based on the spray-dried granules, of sodium gluconate were used instead of sodium carbonate. However, the concentration of the slurry was 75.9% by weight and the viscosity under operating conditions was 12,000 mPas. The spray-dried granules had an apparent density of 762 g/l.

M4/4

3% by weight, based on the spray-dried granules, of sodium gluconate were used instead of sodium carbonate. The concentration of the slurry was 75.9% by weight as in M4/3 although its viscosity under operating conditions was only 10,000 mPas. The spray-dried granules had an apparent density of 749 g/l.

The apparent densities of the individual products according to the invention could be further increased by routine changes familiar to the expert in the conditions prevailing in the spray drying tower.

What is claimed is:

1. Spray-dried granules useful as detergents, cleaning compositions or as a component therefor containing anionic surfactants in an amount of less than 1% by weight, soap in an amount of less than 0.2% by weight, 1 to 30% by weight of nonionic surfactants, 0.2% to 20% by weight of sugar acids or salts of sugar acids, and the balance to 100% by weight of inorganic or organic builders, redeposition inhibitors, foam inhibitors, optical brighteners, enzymes, fabric softeners, dyes, fragrances and neutral salts, based on the weight of said granules, said granules having an apparent density of at east 550 g/l.

2. Granules as in claim 1 having an apparent density of 700 to 1000 g/l.

3. Granules as in claim 1 containing 2 to 25% by weight of nonionic surfactants.

4. Granules as in claim 1 wherein said sugar acids or salts of said sugar acids are selected from the group consisting of polyhydroxymonocarboxylic acids having 4 to 6 carbon atoms or salts thereof, wherein each carbon atom that does not bear a carboxyl group or keto group carries a hydroxy group, and polyhydroxydicarboxylic acids containing 4 to 6 carbon atoms and at least 2 hydroxy groups per molecule, or salts thereof.

5. Granules as in claim 1 containing 0.5 to 15% by weight of gluconic acid, gluconate or mixtures thereof.

6. A granular household detergent composition containing 40% to 90% by weight of the spray-dried granules of claim 1, and the balance to 100% by weight of conventional household detergent composition ingredients.

7. A granular institutional detergent composition containing 40 to 90% by weight of the spray-dried granules of claim 1, and the balance to 100% by weight of conventional institutional detergent composition ingredients.

8. The process of producing spray-dried granules useful as detergents, cleaning compositions, or as a component therefor, comprising preparing a slurry containing 0.2% to 20% by weight of sugar acids or salts thereof and the balance being detergent components, said slurry containing less than 35% by weight of water, less than 1% by weight of anionic surfactants, and less than 0.2% by weight of soap and having a viscosity of less than 15,000 mPas under spray-drying conditions, and spray-drying said slurry.

9. A process as in claim 8 wherein said slurry has a water content of at most 30% by weight.

10. A process as in claim 8 wherein said slurry has a viscosity of less than 12,000 mPas.

11. A process as claimed in claim 8 wherein said sugar acids or salts thereof are selected from the group consisting of polyhydroxymonocarboxylic acids containing 4 to 6 carbon atoms and at least 3 hydroxy groups per molecule, salts thereof, and mixtures thereof, polyhydroxydicarboxylic acids containing 4 to 6 carbon atoms and at least 2 hydroxy groups per molecule, salts thereof, and mixtures thereof.

12. A process as in claim 8 wherein said sugar acids or salts thereof comprise polyhydroxymonocarboxylic acids or polyhydroxymonocarboxylic acid salts containing 4 to 6 carbon atoms, each carbon a tom that does not bear a carboxyl group or keto group carries a hydroxy group.

13. A process as in claim 8 wherein said slurry contains 0.5 to 15% by weight of gluconic acid, gluconate or mixtures thereof, based on the weight of said spray-dried granules.

14. A process as in claim 8 wherein said granules have an apparent density of 700 to 1000 g/l.

15. The product of claim 8.

16. The product of claim 9.

17. The product of claim 10.

18. The product of claim 11.

19. The product of claim 12.

20. The product of claim 13.

* * * * *